US006325751B1

(12) United States Patent
Klintenstedt et al.

(10) Patent No.: US 6,325,751 B1
(45) Date of Patent: Dec. 4, 2001

(54) CENTRIFUGAL SEPARATOR CASING WITH REDUCED SEPARATED PRODUCT DISCHARGE VELOCITY

(75) Inventors: Kjell Klintenstedt, Saltsjo-Boo; Stefan Szepessy, Stockholm, both of (SE)

(73) Assignee: Alfa Laval AB, Tumba (SE)

( * ) Notice: Subject to any disclaimer, the term of this patent is extended or adjusted under 35 U.S.C. 154(b) by 0 days.

(21) Appl. No.: 09/601,977

(22) PCT Filed: Feb. 26, 1999

(86) PCT No.: PCT/SE99/00278

§ 371 Date: Aug. 10, 2000

§ 102(e) Date: Aug. 10, 2000

(87) PCT Pub. No.: WO99/43438

PCT Pub. Date: Sep. 2, 1999

(30) Foreign Application Priority Data

Feb. 27, 1998 (SE) ..... 9800616

(51) Int. Cl.[7] ..... B04B 7/04
(52) U.S. Cl. ..... 494/60
(58) Field of Search ..... 494/1–4, 12, 43, 494/47, 48, 56, 60, 68–73, 85; 210/360.1, 378

(56) References Cited

U.S. PATENT DOCUMENTS

| | | | |
|---|---|---|---|
| 1,762,899 | * | 6/1930 | Thomson et al. . |
| 2,186,033 | | 1/1940 | Milton . |
| 2,628,021 | * | 2/1953 | Staaff . |
| 2,723,799 | * | 11/1955 | Sharples . |
| 2,724,549 | * | 11/1955 | Brown . |
| 2,760,889 | * | 8/1956 | Peltzer, Sr. . |
| 2,973,896 | * | 3/1961 | Peltzer, Sr. . |
| 3,036,760 | * | 5/1962 | Halbach . |
| 3,204,868 | * | 9/1965 | Honeychurch . |
| 3,454,216 | * | 7/1969 | Hemfort . |
| 3,640,452 | * | 2/1972 | Thylefors . |
| 4,325,825 | * | 4/1982 | Schutte . |
| 5,202,024 | * | 4/1993 | Andersson et al. . |
| 5,487,720 | | 1/1996 | Pace . |
| 5,916,083 | * | 6/1999 | Bjorkstrom . |

FOREIGN PATENT DOCUMENTS

| | | | | |
|---|---|---|---|---|
| 1256210 | * | 2/1961 | (FR) | 494/60 |
| 447 544 | | 11/1986 | (SE) . | |
| WO 95/21697 | | 8/1995 | (WO) . | |

* cited by examiner

*Primary Examiner*—Charles E. Cooley
(74) *Attorney, Agent, or Firm*—Fish & Richardson P.C.

(57) ABSTRACT

A centrifugal separator has a centrifuge rotor (1), which is rotatable about a vertical axis (x) of rotation and has at least one outlet (3) around the periphery for intermittently discharging a separated product. The separator has a casing (4), which encloses the rotor, and a space (6), delimited by the rotor (1) and an inner surface of a wall forming a part of the casing. The space (6) is arranged to receive the product from the outlet and has an outlet passage (8) for conveying the product from the space. The inner surface has a first surface portion (9'), located at the level of the outlet and extending inwardly from a second surface portion (9") of the inner surface. The second surface portion is located below the first surface portion and extends around the rotor downwardly and inwardly with respect to the axis (x). The outlet passage (8) is located below the maximum diameter of the second surface portion.

15 Claims, 1 Drawing Sheet

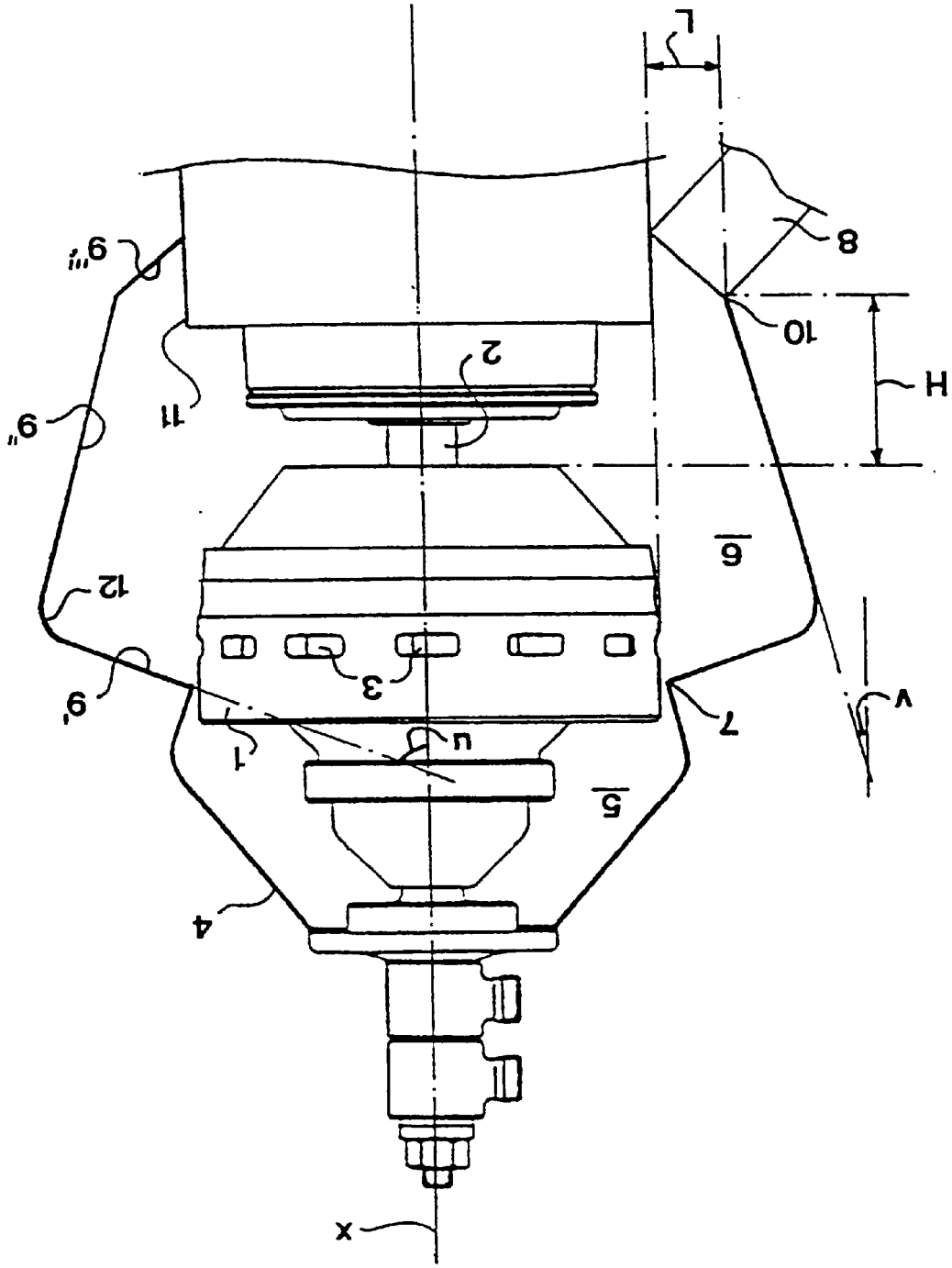
x
4
5
u
1
9'
12
9"
11
9'''
2
3
6
7
v
10
8
H
L

CENTRIFUGAL SEPARATOR CASING WITH REDUCED SEPARATED PRODUCT DISCHARGE VELOCITY

FIELD OF THE INVENTION

The present invention refers to a centrifugal separator comprising: a centrifuge rotor, which is rotatable about an essentially vertical axis of rotation and which around the periphery has at least one outlet being openable during operation and being arranged to discharge intermittently a certain quantity of a separated product; a casing, which encloses the centrifuge rotor; a space, which is delimited by the centrifuge rotor and by an inner surface of a wall extending around the centrifuge rotor and forming a part of the casing, wherein the space is arranged to receive said product from said openable outlet; and an outlet passage, which extends from the space and is arranged to convey said product from the space, wherein the inner surface comprises a first surface portion, located at the level of said openable outlet and extending around the centrifuge rotor and upwardly and inwardly with respect to said axis of rotation from a second surface portion of the inner surface, the second surface portion being located below the first surface portion. Such a centrifugal separator is disclosed in SE-B-447 544.

BACKGROUND OF THE INVENTION

In such centrifugal separators, the separated product, which is discharged through the intermittently openable outlets, has a considerable kinetic energy, which results in a large impulse, when the product impacts on the wall. The discharge takes place very quickly and the separated product impacts on the receiving parts of the casing at the same time as the product is broken and forms spatter distributed in the space within the casing in a plurality of directions which are frequently not controllable. Although a part of the kinetic energy of the separated product is utilized for feeding the separated product from the centrifuge rotor through the outlet passage, the main part of the kinetic energy has to be removed from the product before it finally leaves the centrifugal separator, i.e. the velocity of the separated product has to be reduced. By the technique available today, it is not possible to provide a sufficient velocity reduction to the separated product in the space within the casing. Therefore, the necessary velocity reduction frequently is obtained by means of a so-called sludge cyclone, which is located outside the centrifugal separator proper in connection to the outlet passage. Such sludge cyclones are expensive and result in a complicated and spacious centrifugal separator. SE-447 544 mentioned above discloses for instance a chute provided in the space and extending around almost the whole centrifuge rotor and being intended to convey the separated product to an outlet extending into a tube. This known chute is, however, insufficient for reducing the velocity of the separated product and thus a sludge cyclone is required downstream of the outlet disclosed.

WO-A-95/21697 discloses a centrifugal separator for separating solid particles from a liquid and having a centrifuge rotor which is designed as a basket having a perforated wall and which widens conically in an upward direction. At the upper end of the conical centrifuge basket, there is a lip over which the solid particles leave the centrifuge basket in a direction outwardly towards a curved deflection plate. When the particles impact on the deflection plate, their velocity is reduced and their direction of movement is changed towards a collecting chamber from which they may be discharged through an outlet. Due to the feeding of the solid particles upwardly, it is necessary that the particles rotate at the upper edge of the centrifuge rotor in order to be able to be discharged from the centrifuge rotor.

SUMMARY OF THE INVENTION

The object of the present invention is to provide a centrifugal separator, which makes it possible to discharge a separated product from a centrifuge rotor and out of the centrifugal separator in a more controlled manner than up to now.

This object is obtained by the centrifugal separator initially defined, which is characterized in that the second surface portion is essentially rotary symmetric and extends around the centrifuge rotor and downwardly and inwardly with respect to said axis of rotation and that the outlet passage is located below the maximum diameter of the second surface portion with respect to said axis of rotation. By such a centrifugal separator, the main part of the separated product discharged through the openable outlet will be caught by the first surface portion and its velocity in the radial direction of movement will be reduced. The main part of the separated product will rotate along the first surface portion and move towards and reach the second rotary symmetric surface portion along which it continues to rotate at a high velocity. Due to the friction against the second surface portion, the velocity of the separated product will decrease, which means that the rotative effect of the gravitation increases. When the effect of the gravitation exceeds the effect of the centrifugal force in a vertical direction, the separated product will move downwardly along the second surface portion and be conveyed out through the outlet passage. Thereby, the velocity of the separated product has been reduced to such an extent that it may be taken care of in an easy manner outside the centrifugal separator without first passing a sludge cyclone. By the fact that the second surface portion inclines downwardly and radially inwardly, the downwardly directed effect of the gravitation to the separated product is delayed, i.e. the friction against the second surface portion, which contributes to the reduction of velocity, may act during a longer time period than if the second surface portion would have been extended vertically. Thanks to the fact that the second surface portion is rotary symmetrical, i.e. the surface is even without any parts, projecting inwardly from the surface and hindering the product from flowing in the peripheral direction along the second surface portion, the separated product will move downwardly in a controlled manner.

Further advantages of the invention are obtained by the different embodiments, which are defined in the dependent claims and the following description.

According to an embodiment of the invention, a first connection line, extending in an axial plane between a radially outermost point and a radially innermost point of the first surface portion, forms a first angle, which is less than 90° and greater than 30°, to said axis of rotation. According to a particular embodiment, the first surface portion may be essentially conical.

According to a third embodiment of the invention, the second surface portion and the outlet passage form an edge, which defines at least a part of an orifice of the outlet passage. Thereby, a second connection line, extending in an axial plane between a radially outermost point of the second surface portion and a radially outermost point of said edge, may form a second angle, which is greater than 0° and less than 45°, to said axis of rotation. By such an angle of inclination of the second surface portion, the velocity of the separated product will be reduced against the surface portion during the downward movement of the product. The second angle may, by a man skilled in the art, in an easy manner be adapted to different properties of the separated product, in the first place its viscosity, i.e. a high viscosity requires a relatively small second angle, whereas a low viscosity requires a relatively great second angle. Thereby, said second angle may, according to a further embodiment, be less than or equal to 35°, furthermore greater than or equal to 2°. According to a special embodiment, the second surface portion may be essentially conical.

According to a further embodiment of the invention, the lowest point of the orifice, with respect to said axis of rotation, coincides essentially with the lowest point of the space. Thereby, it is ensured that all separated products also will be discharged from the centrifugal separator, i.e. from the space within the casing.

According to a further embodiment of the invention, the space, with respect to said axis of rotation, extends below the lowest point of the centrifuge rotor and the highest point of the orifice is located below the lowest point of the centrifuge rotor. During the rotation of the centrifuge rotor, an airflow is formed in the space outside the rotor. By means of the proposed design of the space, this flow will extend along a closed path, which is directed downwardly and in parallel to the second surface portion in the proximity thereof. Thereby, this flow will contribute to the transport of the sludge in the space downwardly towards the outlet passage, which improves the cleanness of the space.

In addition, due to the fact that the highest point of the orifice is located below the lowest point of the centrifuge rotor, the difference of the air pressure inside the orifice and the air pressure outside the opposite ends of the outlet passage will be small and thus also the air flow through the outlet passage is small.

BRIEF DESCRIPTION OF THE DRAWINGS

The present invention be described more closely by means of an embodiment and with reference to the drawing attached in which the drawing discloses schematically a sectional view of a centrifugal separator according to the present invention.

DETAILED DESCRIPTION

The drawing discloses a centrifugal separator comprising a centrifuge rotor 1 which is rotatable about a rotor axis x of rotation and carried and driven by a vertical drive spindle 2, which is connected to a driving unit. The centrifuge rotor 1 comprises around its periphery a number of outlets 3 which are openable during operation and which are arranged to intermittently discharge a certain quantity of a product separated in the centrifuge rotor 1. Furthermore, the centrifuge rotor is enclosed in a stationary casing 4. The casing 4 is designed in such a manner that a first upper space 5 and a second lower space 6 are formed between the casing 4 and the centrifuge rotor 1. The upper space 5 and the lower space 6 are separated by means of a curvature 7 of the casing 4, which points inwardly towards a part of the centrifuge rotor 1 that is located above the outlets 3 in such a manner that a thin gap is formed between the casing 4 and the centrifuge rotor 1 in the area of the curvature 7. Above the curvature 7, the wall of the casing 4 widens outwardly in an essentially conical manner.

The lower space 6, which is defined by the centrifuge rotor 1 and the inner surface of the wall of the casing 4, is arranged to receive the separated product from the openable outlets 3. The product received is conveyed away from the lower space 6 through an outlet passage 8 extending from the lower space 6. The inner surface delimiting the lower space 6 comprises a first upper surface portion 9' which is located at the level of the openable outlets 3 and which extends upwardly and inwardly with respect to the axis x of rotation from a second surface portion 9" of the inner surface, which thus is located below the first surface portion 9'. Consequently, the first surface portion 9' extends inwardly to the gap formed between the curvature 7 and the centrifuge rotor 1. In the embodiment disclosed, the first surface portion 9' is essentially conical. However, it is to be noted that the first surface portion 9' also may extend along a curved line, i.e. being arched. The first surface portion 9' forms a first connection line, which extends in an axial plane between a radially outermost point and a radially innermost point of the first surface portion 9'. The first connection line, which in the example disclosed coincides with the first surface portion 9' in an axial section, forms a first angle u to the axis x of rotation. The angle u is less than 90° and greater than 30°.

Consequently, the second surface portion 9" extends from the first surface portion 9' downwardly and inwardly with respect to the axis x of rotation. The outlet passage 8 is located below the second surface portion 9". The second surface portion 9" and the outlet passage 8 form an edge 10, which delimits at least a part of the orifice of the outlet passage 8. It is to be noted that the outlet passage 8 may comprise a simple pipe, which has an orifice in the wall of the casing 4. The pipe may be circular cylindrical or have any arbitrary cross-sectional shape. In the example disclosed, the second surface portion 9" connects to a third surface portion 9'" at the level of the edge 10. The third surface portion 9'" extends downwardly to the lowest point of the lower space 6 and connects to a screening portion 11 which thus is located at the level of the outlet passage 8 and has an essentially circular cylindrical surface which extends upwardly and is concentrical to the axis x of rotation. Consequently, this surface is located opposite to the third surface portion 9'" and a lower part of the second surface portion 9". It is to be noted that the second surface portion 9" and the third surface portion 9'" may form a common surface portion, i.e. the transition disclosed between these surface portions may be dispensed with. The second surface portion 9" forms a second connection line, which extends in an axial plane between a radially outermost point of the second surface portion 9" and a radially outermost point of the edge 10. This second connection line, which in the example disclosed coincides with second surface portion 9" in an axial section, forms a second angle v to the axis x of rotation. The second angle is at least greater than 0° and less than 45°. In a preferred embodiment, the second angle v is less than or equal to 35°. According to another preferred embodiment, the second angle v is greater than or equal to 2°. Furthermore, in the embodiment disclosed, the second surface portion 9" is essentially conical, which however is not necessarily the case but the second surface portion 9" may also be arched or comprise several different portions having different angles of inclination.

The first surface portion 9' and the second surface portion 9" intersect in a common continuous border area 12 forming a smooth transition between the surface portions 9' and 9". The volume which is formed in the lower space 6 radially outside and above a radially outermost point of the edge 10, is less than the volume of the total discrete quantity from all openable outlets 3.

The centrifuge rotor 1 has an outer surface with a surface portion, which delimits the lower space 6. The openable outlets 3 are located in the area of the surface portion, where the latter has its greatest diameter and essentially opposite to the first surface portion 9'. The highest point of the orifice of the outlet passage 8 is located radially outside the greatest diameter of the surface portion of the centrifuge rotor 1 and at a radial distance L from this surface portion. The surface portion extends further downwardly and inwardly with respect to the axis x of rotation below the greatest diameter of the surface portion. The lowest point of the orifice of the outlet passage 8 coincides essentially with the lowest point of the lower space 6, as appears from the figure. Furthermore, the lower space 6 extends below the lowest point of the centrifuge rotor 1 and the highest point of the orifice of the outlet passage 8 is located below the lowest point of the centrifuge rotor 1, i.e. the lowest point of the centrifuge rotor 1 in the lower space 6 is located at the axial distance H from the highest point of the orifice of the outlet passage 8.

The first and second surface portions 9' and 9" as well as the border area 12 are essentially rotary symmetrical, i.e. these surfaces have no projecting portions or components such as for instance guide vanes for producing a change of direction of the separate product. In order to increase the friction, when needed, between the rotary product and the non-rotating wall material, the surface portions may be made rough or provided with for instance vertical grooves or recesses which are filled with the product acting with a higher coefficient of friction against the rotary product.

The intermittently discharged separated product will thus hit the first surface portion 9' at a high velocity. Since the product impacts on the first surface portion 9' with a relatively small angle, it will be deflected in a relatively smooth manner without the formation of large quantities of spatter. At this moment, the separated product has a very high rotation velocity and will thus move outwardly towards the largest diameter of the inner wall of the casing 4. Due to the friction against the inner wall, the velocity and the kinetic energy of the product will, however, decrease, which means that the product in due time under the effect of the gravitation force will move downwardly along the second surface portion 9". Due to the continuous or rotary symmetric design of the second surface portion 9", and also of the first surface portion 9' and the border area 12, the separated product will move downwardly in a controlled manner. When the product reaches the edge 10, its velocity and kinetic energy has declined to such an extent that it may be conveyed out through the outlet passage 8 in an easy manner.

The present invention is not limited to the embodiment disclosed but may be varied and modified within the scope of the following claims.

What is claimed is:

1. A centrifugal separator comprising:

a centrifuge rotor (1), said centrifuge rotor being rotatable about an essentially vertical axis (x) of rotation and around the periphery having at least one outlet (3) being openable during operation and being arranged to discharge intermittently a certain quantity of a separated product;

a casing (4), enclosing the centrifuge rotor;

a space (6), being delimited by the centrifuge rotor (1) and by an inner surface of a wall extending around the centrifuge rotor and forming a part of the casing (4), wherein the space (6) is arranged to receive said product from said openable outlet (3); and an outlet passage (8), extending from the space (6) and arranged to convey said product from the space (6), wherein the inner surface comprises a first surface portion (9'), located at the level of said openable outlet (3) and extending around the centrifuge rotor (1) and upwardly and inwardly with respect to said axis (x) of rotation from a second surface portion (9") of the inner surface, the second surface portion being located below the first surface portion, said first and second surface portions (9',9") at their intersection forming a continuous border area (12), wherein the second surface portion (9") is essentially rotary symmetric and extends around the centrifuge rotor (1) and downwardly and inwardly with respect to said axis (x) of rotation and the outlet passage (8) is located below the maximum diameter of the second surface portion (9") with respect to said axis (x) of rotation.

2. A centrifugal separator according to claim 1, having a first connection line, extending in an axial plane between a radially outermost point and a radially innermost point of the first surface portion (9'), and forming a first angle (u), said first angle being less than 90° and greater than 30°, to said axis (x) of rotation.

3. A centrifugal separator according to claim 2, wherein the second surface portion (9") and the outlet passage (8) form an edge (10), said edge defining at least a part of an orifice of the outlet passage (8).

4. A centrifugal separator according to claim 3, having a second connection line, extending in an axial plane between a radially outermost point of the second surface portion (9") and a radially outermost point of said edge (10), and forming a second angle (v), said second angle being greater than 0° and less than 45°, to said axis (x) of rotation.

5. A centrifugal separator according to claim 4, wherein said second angle (v) is less than or equal to 35°.

6. A centrifugal separator according to claim 4, wherein the second surface portion (9") is essentially conical.

7. A centrifugal separator according to claim 3, wherein at least the highest point of the orifice is located radially outside the greatest diameter of a surface portion of the centrifuge rotor.

8. A centrifugal separator according to claim 1, wherein the first surface portion (9') is essentially conical.

9. A centrifugal separator according to claim 1, having a screening portion (11) located at the level of the outlet passage (8) and having a surface extending upwardly and facing at least a part of the second surface portion (9") and forming, together with the part, a capturing pocket for said product.

10. A centrifugal separator according to claim 1, wherein the centrifuge rotor (1) has an outer surface having a surface portion delimiting the space, and wherein the outlets (3) are located in the area of the greatest diameter of the surface portion.

11. A centrifugal separator according to claim 10, wherein the surface portion of the centrifuge rotor extends downwardly with respect to said axis (x) of rotation.

12. A centrifugal separator according to claim 10, wherein at least the highest point of an orifice of the outlet passage (8) is located radially outside the greatest diameter of the surface portion of the centrifuge rotor.

13. A centrifugal separator comprising:

a centrifuge rotor (1), said centrifuge rotor being rotatable about an essentially vertical axis (x) of rotation and around the periphery having at least one outlet (3) being openable during operation and being arranged to discharge intermittently a certain quantity of a separated product;

a casing (4), enclosing the centrifuge rotor;

a space (6), being delimited by the centrifuge rotor (1) and by an inner surface of a wall extending around the centrifuge rotor and forming a part of the casing (4), wherein the space (6) is arranged to receive said product from said openable outlet (3);

an outlet passage (8), extending from the space (6) and arranged to convey said product from the space (6), wherein the inner surface comprises a first surface portion (9'), located at the level of said openable outlet (3) and extending around the centrifuge rotor (1) and upwardly and inwardly with respect to said axis (x) of rotation from a second surface portion (9") of the inner surface, the second surface portion being located below the first surface portion;

a first connection line, extending in an axial plane between a radially outermost point and a radially innermost point of the first surface portion (9'), and forming a first angle (u), said first angle being less than 90° and greater than 30°, to said axis (x) of rotation, wherein the second surface portion (9") and the outlet passage (8) form an edge (10), said edge defining at least a part of an orifice of the outlet passage (8); and a second connection line, extending in an axial plane between a radially outermost point of the second surface portion (9") and a radially outermost point of said edge (10), and forming a second angle (v), said second angle (v) being greater than or equal to 2° and less than 45°, to said axis (x) of rotation, wherein the second surface portion (9") is essentially rotary symmetric and extends around the centrifuge rotor (1) and downwardly and inwardly with respect to said axis (x) of rotation and the outlet passage (8) is located below the maximum diameter of the second surface portion (9") with respect to said axis (x) of rotation.

14. A centrifugal separator comprising:

a centrifuge rotor (1), said centrifuge rotor being rotatable about an essentially vertical axis (x) of rotation and around the periphery having at least one outlet (3) being openable during operation and being arranged to discharge intermittently a certain quantity of a separated product;

a casing (4), enclosing the centrifuge rotor;

a space (6), being delimited by the centrifuge rotor (1) and by an inner surface of a wall extending around the centrifuge rotor and forming a part of the casing (4), wherein the space (6) is arranged to receive said product from said openable outlet (3); and an outlet passage (8) extending from the space (6) and arranged to convey said product from the space (6), wherein the inner surface comprises a first surface portion (9'), located at the level of said openable outlet (3) and extending around the centrifuge rotor (1) and upwardly and inwardly with respect to said axis (x) of rotation from a second surface portion (9") of the inner surface, the second surface portion being located below the first surface portion, wherein the second surface portion (9") is essentially rotary symmetric and extends around the centrifuge rotor (1) and downwardly and inwardly with respect to said axis (x) of rotation and the outlet passage (8) is located below the maximum diameter of the second surface portion (9") with respect to said axis (x) of rotation, and further wherein the second surface portion (9") and the outlet passage (8) form an edge (10), said edge defining at least a part of an orifice of the outlet passage (8) and further wherein the lowest point of the orifice with respect to said axis (x) of rotation coincides essentially with the lowest point of the space (6).

15. A centrifugal separator comprising:

a centrifuge rotor (1), said centrifuge rotor being rotatable about an essentially vertical axis (x) of rotation and around the periphery having at least one outlet (3) being openable during operation and being arranged to discharge intermittently a certain quantity of a separated product;

a casing (4), enclosing the centrifuge rotor;

a space (6), being delimited by the centrifuge rotor (1) and by an inner surface of a wall extending around the centrifuge rotor and forming a part of the casing (4), wherein the space (6) is arranged to receive said product from said openable outlet (3); and an outlet passage (8) extending from the space (6) and arranged to convey said product from the space (6), wherein the inner surface comprises a first surface portion (9'), located at the level of said openable outlet (3) and extending around the centrifuge rotor (1) and upwardly and inwardly with respect to said axis (x) of rotation from a second surface portion (9") of the inner surface, the second surface portion being located below the first surface portion, wherein the second surface portion (9") is essentially rotary symmetric and extends around the centrifuge rotor (1) and downwardly and inwardly with respect to said axis (x) of rotation and the outlet passage (8) is located below the maximum diameter of the second surface portion (9") with respect to said axis (x) of rotation, and further wherein the second surface portion (9") and the outlet passage (8) form an edge (10), said edge defining at least a part of an orifice of the outlet passage (8) and further wherein the space (6), with respect to said axis (x) of rotation, extends below the lowest point of the centrifuge rotor (1) and the highest point of the orifice is located below the lowest point of the centrifuge rotor (1).

* * * * *